US007438613B2

(12) United States Patent
Hubbs

(10) Patent No.: US 7,438,613 B2
(45) Date of Patent: Oct. 21, 2008

(54) MARINE ENGINE GRAVITY DRAIN SYSTEM

(76) Inventor: William O. Hubbs, 6282 Rocky Grove, Cedar Hill, MO (US) 63016

( * ) Notice: Subject to any disclaimer, the term of this patent is extended or adjusted under 35 U.S.C. 154(b) by 57 days.

(21) Appl. No.: 11/429,689

(22) Filed: May 8, 2006

(65) Prior Publication Data

US 2006/0258236 A1 Nov. 16, 2006

Related U.S. Application Data

(60) Provisional application No. 60/681,679, filed on May 16, 2005.

(51) Int. Cl.

| | |
|---|---|
| ***B63H 21/10*** | (2006.01) |
| ***B63H 21/38*** | (2006.01) |
| *B63H 21/14* | (2006.01) |
| *F01P 3/20* | (2006.01) |
| *F02B 61/04* | (2006.01) |
| *B63B 13/00* | (2006.01) |

(52) U.S. Cl. ..... 440/88 R; 440/88 C; 440/88 N

(58) Field of Classification Search ..... 440/88 R, 440/88 C, 88 N; 137/606

See application file for complete search history.

(56) References Cited

U.S. PATENT DOCUMENTS 4,693,690 A * 9/1987 Henderson ..... 440/88 R
6,050,867 A * 4/2000 Shields et al. ..... 440/88 C

* cited by examiner

*Primary Examiner*—Lars A Olson
*Assistant Examiner*—Daniel V Venne
(74) *Attorney, Agent, or Firm*—Paul M. Denk

(57) ABSTRACT

A marine engine quick drain system that is comprised of several engine block drain connections, provided in the area of the engine that must be drained, which drain by means of flow tubes to a drainage connector, a drainage connector which preferable is mounted on a slight incline, stably supported upon a bracket, to the boat hull, the lower end of the collector having a drain valve, such as a spring loaded lever valve, connecting with another singular drain tube, to the hull drain port, such that when the levered valve is opened, all of the coolant fluids and water within the boat engine will drain back into the lake, to empty the engine of any freezable water, when the boat is stowed, upon a boat lift, as when not in usage.

9 Claims, 3 Drawing Sheets

MARINE ENGINE GRAVITY DRAIN SYSTEM

CROSS REFERENCE TO RELATED APPLICATION

This nonprovisional patent application claims priority to the provisional patent application having Ser. No. 60/681,679 which was filed on May 16, 2005.

FIELD OF INVENTION

This invention relates to the removal of coolant liquid from an engine, and more specifically, pertains to a valve controlled engine drain system which when the vessel is elevated upon its lift, and upon actuation of its valve, provides for a gravity drain of the engine cooling liquid, normally water.

BACKGROUND OF THE INVENTION

In pleasure and sport boating, there are many various designs that incorporate and employ various types of engines. The type of engine used, and the design of the engine that is addressed in this disclosure, relates to the very popular inboard outdrive. It uses an automotive type of engine, usually of the V-8 type, as an example, and normally of the more heavy duty engine as employed for marine usage.

A common way to cool such an engine is to pick up and pump water from the lake or river, and circulate the water through the engine block, and then return the heated water back to the lake or river, through the exhaust system.

In many areas of the country, where this type of a boat or vessel is used, the temperature during the winter months descends, and frequently down to and below the freezing level of the lake water. Because of these potentially low temperatures, this type of engine design, when used, must be drained and winterized to protect it from the lack of use and to prevent any freeze damage, such that might possible crack an engine block, if care is not exercised.

Normally, in the cooler temperature areas, as an example, most boat owners will winterize their boat at the end of October, and will not utilize the boat all winter long, until around mid-April, when they are assured that freezing temperatures may be avoided. The problem, though, is that it is almost half a year of inactivity, when one cannot utilize his/her boat for pleasure or other usage. As one can imagine, when the temperature of the weather may not become so cold and unpleasant, and remain that way all winter long, there may be periods of time when pleasure boating may be enjoyable, even during the late fall or early spring months, when there are those periods of mild weather, from time to time, when one would like to use his/her boat. But, normally, such is not practical, because if the boat has already been winterized, to protect it from another cold spell that may eventually come, so the boat must be re-winterized, each time usage occurs.

Hence, there have been some systems developed, and deployed, that provide for a more rapid drainage of the boat, but many of these types of devices are rather inconvenient of usage, require reaching down into the empty spaces of the hull, or climbing down therein, in order to provide for a release of a drainage means, to allow the engine block and other coolant areas to be drained, to prevent freezing of the engine during experiencing cold weather.

Examples of these types of devices, as known in the art, can be seen in the following patents.

As an example, the patent to Henderson, U.S. Pat. No. 4,693,690, shows a quick drain assembly for a boat motor.

This particular drain assembly is for use with a small pleasure boat, apparently one which does not necessarily incorporate an inboard motor, with the patent defining that this type of boat is normally of the type that is transported by a trailer. Hence, such a boat normally is not kept upon a boat lift, within a boat stall, which is the type of usage employed for the currently designed invention. The shown device does incorporate a series of hoses, connected between the engine block, and a quick drain device, with the device being shown as a housing, being cylindrical in design, and located therein is a packer element, which as one can see, is like the standard bottle stopper that can expand when the handle is turned downwardly, to close off the drain. But, to put this type of a mechanism into a boat hull, with the inboard outdrive type of engine, normally requires the boat owner to climb down into the hull, attain access to the drain plug, release it, allow drainage to occur, and then reapply the plug, once the emptying has occurred. But, once again, what is shown in Henderson has been defined as for use upon the type of boat that may be trailered, and not one that may be elevated upon a boat lift, as within its dock stall.

The patent to Inoue, et al., U.S. Pat. No. 5,334,063, shows a cooling system for a marine propulsion engine. This device defines a water craft, with an internal combustion engine, having a cooling jacket, a conduit means for supplying water from the body of water from which the watercraft is operating into the engine cooling jacket. And, it also includes a two position two-way valve means, for selectively communicated said cooling jacket to a drain for draining said jacket and for selectively communicating said cooling jacket to its conduit means for delivering water to the cooling jacket during usage. This device is more concerned in providing an overall cooling system for a marine propulsion engine, rather than providing for a quick drain of the same.

The patent to Shields, et al., U.S. Pat. No. 6,050,867, shows a drain system for a marine vessel. This particular drain system, though, includes a multiple conduit structure, which apparently is a type of structure which is provided through the lower transom of the boat, attaches to multiple conduits, and then has a series of plugs that can be released for allowing the water to be drained from the boat, or its engine, during or after usage. This is a far more complex type of drain system.

The patent to Biggs, et al., U.S. Pat. No. 6,089,934, shows an engine cooling system with simplified drain and flushing procedure. This device describes the need for a first opening extending to a first portion of the engine, and into the cooling system, and a flexible conduit communicating with the first opening, with a retainer removable attached to the first flexible conduit and movable between a first end of the flexible conduit and the second end of the first flexible conduit, for providing drainage of the engine cooling system. This device does show a handle and a retainer for manipulating these components.

The patent to Logan, et al., U.S. Pat. No. 6,135,064, is upon another engine drain system. This one includes a manifold having internal passages. A manifold, by its own definition, is provides primarily for allowing circulation of engine coolant to the jacket, and from the jacket, and which may even have a draining system incorporated therein, but the manifold is primarily operative during usage of the boat, to provide for circulation of the coolant liquid, particularly during engine operation. It may also include, in its complex structure, a drain, which when opened, allows the water to flow out of the manifold, and apparently to the lake.

Another patent to Biggs, et al., U.S. Pat. No. 6,343,965, shows a pneumatically operated marine engine water drain system. The particular drainage system of this patent includes various pressure actuated valves, and a controller connected therewith, with the controller comprising an internal manifold that is connected in fluid communication with the first pressure conduit and a pressure indicator for indicating a change in pressure within its first pressure conduit. These types of structures are not incorporated into the drainage system of current invention.

Another patent to Biggs, et al., U.S. Pat. No. 6,379,201, is upon another style of marine engine cooling system with a check valve to facilitate draining. This particular device also defines a marine engine cooling system, having a valve, with a first, second and third ports, and there being a ball disposed within the cavity within each port, which incorporates a pump in fluid communication with at least the first port, and with the actuation of the pump and the third port with the ball providing for maintaining balance between the various second and first ports depending upon the amount of fluid pressure generated at the second port during engine operation. This is a very detailed structure, which is just not embodied in the current invention. The current invention does not use any type of ball valve regulated by pressure within its drainage device.

The patent to Hughes, et al., U.S. Pat. No. 6,390,870, is another marine engine cooling system with simplified water drain and flushing mechanism. This particular system also includes a structured manifold, with a water pump that draws water out of a body of water to flow into the manifold and also incorporates a drain conduit. The current invention does not incorporate any type of a structured manifold, that may operate with a water pump to take intake water from the lake, and pass through to the manifold for circulation in various directions through the vessel engine.

Finally, the patent to Kinomoto, et al., U.S. Pat. No. 6,827,048, shows another cooling system for a marine engine. This particular system is more concerned with the cooling system, and its circulation, within a marine engine, and its surrounding cooling jacket, rather than providing a simple device for draining of fluids, as when the boat is elevated, and not in use.

Other prior art patents relating to early type systems include U.S. Pat. Nos. 4,619,618, 4,699,598, 5,067,448, 5,329,888, 5,362,266, 5,393,252, 5,441,431, 5,579,727, 5,628,285, 5,664,526, and 5,980,342. These are examples of prior art known to the Applicant.

SUMMARY OF THE INVENTION

This invention relates to a marine engine quick drain system, that is comprised of several engine block drain connections, and hoses for attachment thereto, from areas of the engine that must be drained, such as the block, the area of the water pump, etc., with all of these hoses being joined together at a connection to a single drainage connector, to provide for rapid drainage of the engine. At the outlet end of the drainage collector, there is provided a spring loaded lever actuated drain valve, which is manipulated either manually, through a cable, or even electrically, as through a switch actuated solenoid, to provide for opening of the valve, and provides for immediate drainage of all the water or coolant fluids from the boat engine, during usage. Thus, for example, when the boat having an inboard engine is pulled into its slip, within a boat dock, and elevated by means of its lift, which many boat docks now frequently include, the valve may be immediately opened, the engine will drain within a matter of minutes, as desired. Hence, should the weather turn foul, or shortly thereafter, or until the next time that the owner plans to use the boat, the engine will be emptied of its fluids, and water, and freezing of its block or other components is completely obviated.

Since gravity drainage is the principle of usage, the drainage collector will be mounted at a position, upon the lower hull, below the level of the engine, for all of those areas to be drained, and a bracket holds the collector in place down upon the hull, to make it a stationary installation. The valve may be mounted to one end of the collector, so that it has very stable and stationary support, particularly when any cable is used to actuate its lever, to provide for opening of the valve to achieve drainage. Then, a short line to a drain plug, that forms a hull drain port upon the hull, and which is streamlined of installation upon the hull so that very little protuberance occurs exteriorly, and which could act as a resistance to water flow, when the boat is moving, is the type of low profile drain that is used and installed through the hull to provide for drainage of the liquid out of its port.

It is, therefore, a principal object of this invention to provide a drainage collector and valve assembly that may be installed inboard of a boat, can be readily actuated to provide for instant drainage of any cooling fluids or water from the boat engine block, as during storage.

Another object of this invention is to provide means for allowing the engine water to be instantly drained, in a short period of time, with little effort on the part of the boat operator, so that every time the boat is brought into its dock, and elevated by its lift, it can be instantly drained in order to better preserve the mechanical components of the vessel.

Another object of this invention is to provide means to eliminate or substantially reduce the incidence of mold and mildew, from forming within a boat hull, because of the presence of standing water in the bilge area, and elsewhere, in the type of boat that does not provide for accelerated drainage, other than when it is permanently winterized.

Still another object of this invention is to provide a marine engine quick drain system that can be easily installed even by the boat owner himself/herself, with little mechanical effort.

Yet another object of this invention is to provide a quick drain system that can be applied as an after market product, by any owner of the boat, and need not necessarily be installed only during boat manufacture.

These and other objects may become more apparent to those skilled in the art upon review of the summary of this invention, and upon undertaking a study of the description of the preferred embodiment, in view of the drawings.

DESCRIPTION OF THE PREFERRED EMBODIMENT

The essence of this invention is to provide a single drain valve that drains all lines leading from various structural aspects of the boat engine, rather than requiring multiple valves as may be employed in other drainage systems. The single drain valve is spring loaded, and lever actuated, whether it be actuated by means of a cable, or electrically, as through a switch actuated solenoid, to attain prompt drainage through a boat hull drain port. Obviously, the benefits of this invention is that a single drain valve that may be remotely operated by a single pull handle that is conveniently located but obscured from view within the interior seating area of the operators position, within the boat. While other drainage systems, raising the engine hatch cover and entering the engine compartment is not required with the current invention. The most unique feature of this invention is the ability to drain the engine coolant water through the bottom of the hull, and back into the lake, and not simply to deliver it to a bilge area, as done with other systems. Hence, the generation of mold is obviated through the usage of this current invention.

Figure 1:
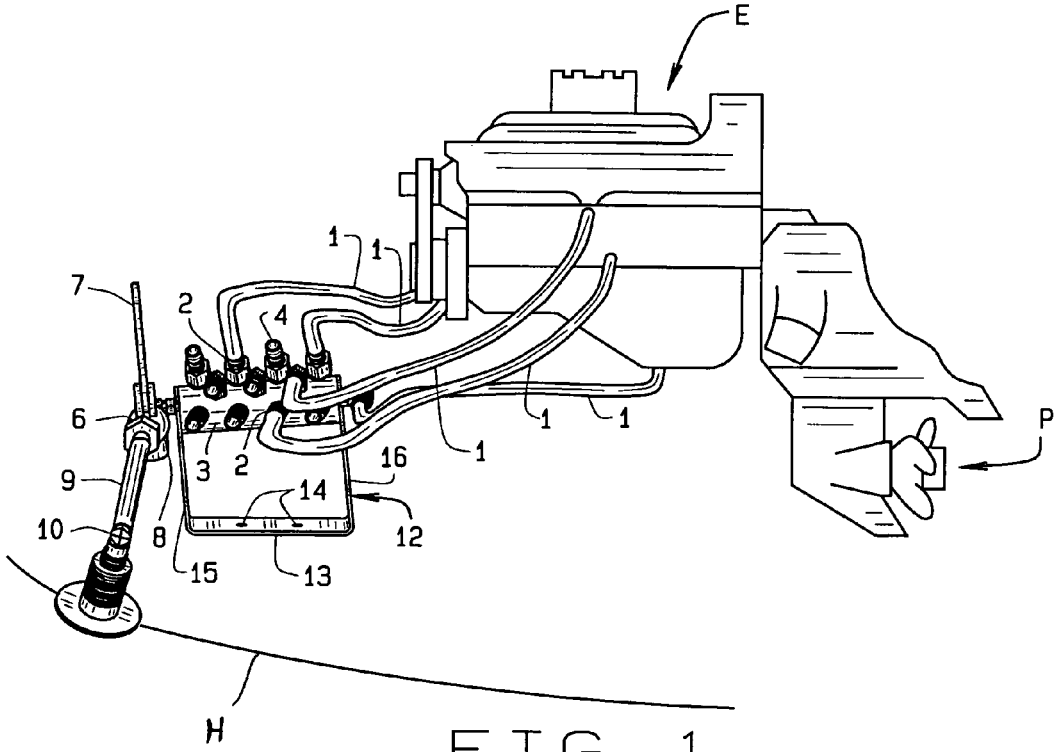
FIG. 1 is a schematic view of the boat engine, its motor, the flow lines leading towards a supportive drainage collector, and its valve for allowing drainage of water out of the hull drain port.

As can be seen in FIG. 1, this is a schematic of just part of the boat, with the hull H of the boat, at the bottom of the boat shown therein. Normally, the engine E is structurally supported within the boat, normally at the back end, approximate its transom, with the gear systems and propeller, as at P, being located exteriorly of the rear of the boat, as well known in the art. In this particular invention, there are a series of flow tubes, as at 1, which connect to all aspects of the engine, where coolant water flows therethrough, and which flow tubes connect with fittings 2 that are integrally provided, and are mechanically engaged with the drainage collector 3 of this particular invention. Those particular fittings, as at 4, which are not employed, may be capped, or otherwise plugged, so as to close off their opening or access. The tubes are only of that internal diameter, perhaps a quarter inch, sufficient to allow for drainage of fluid, but does not provide for any type of circulation of the fluid therein, back into the engine, once drained. Hence, this is strictly a drainage instrument, and not a circulatory type of manifold, as shown in the prior art.

In addition, the collector itself is only of that size which allows for immediate accumulation of water, and for flow out of its outlet end 5, and as can be seen, and the collector has a slight incline so that all water entering into it, will likewise flow to its low side, as at the outlet 5, to assure that all of the water that is being drained, is removed, from the engine, and the collector system, during application. The outlet side port 5 may be at the lower edge of the collector 3, to assure that all of the fluids are evacuated.

Connecting with the outlet port 5, through another fitting, is a spring loaded lever valve 6 with its lever 7 that operates internally of its valve housing 8 to provide for opening of the valve, when the lever is pulled open, to provide for free access and drainage of the liquids from within the engine, and the collector, during its usage. At the outlet end of the valve is another singular flow tube 9, which connects by another connector or elbow, as at 10, to a drain 11, that may be threadedly applied permanently through an aperture cut into the boat hull, by the installer. The drain 11 has a very low profile, particularly on its exterior bottom surface, so that it does not provide much in the way of any resistance to the flow of lake water thereby, as the boat is being operated.

In addition, as can be seen, the drainage collector 3 is stably supported by a bracket 12, which is a U-shaped type of bracket, having a base portion 13 through which screws may be applied through its apertures 14 into the hull, to provide for its stable mount, and the upstanding legs 15 and 16 are provided for rigid attachment to the ends of the collector, to provide for its stable support. The leg 16 may be slightly longer than the leg 15, so that the collector can be arranged upon a slight incline, with the port 5, holding the lever valve 6, being slightly lower than the opposite end of the collector, so as to provide for that complete drainage of all fluids from even the collector, once the engine is drained.

Figure 2:
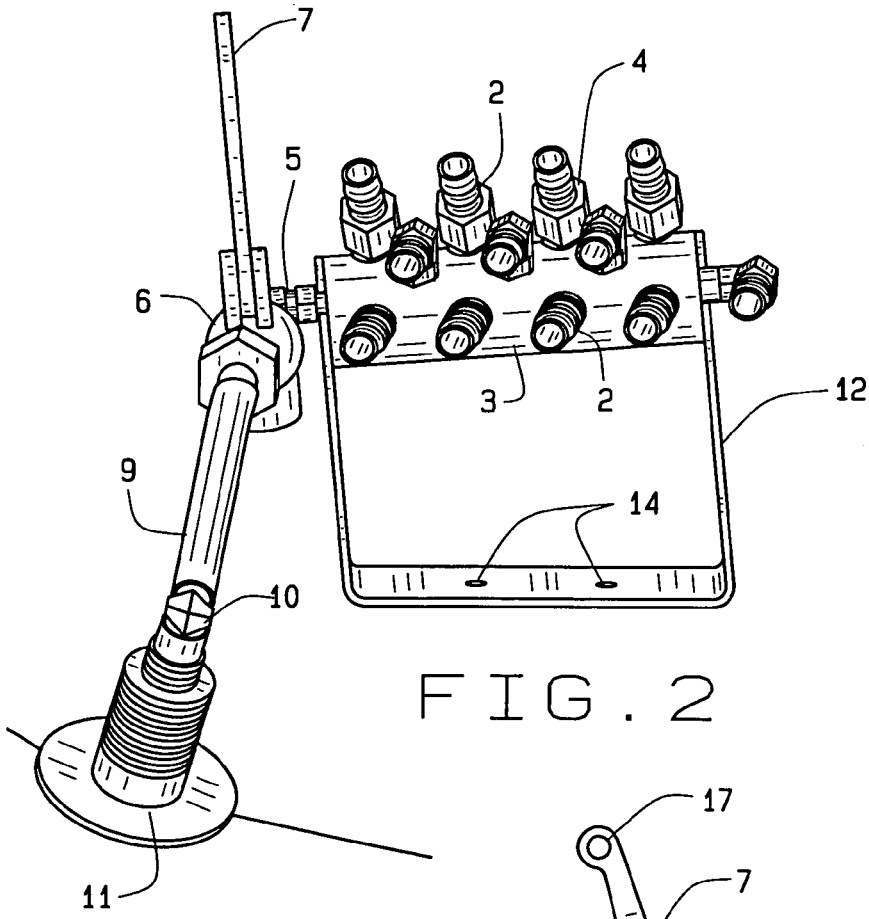
FIG. 2 is an enlarged view of the drainage collector and valve as connected by a singular flow line to its hull drain port.

FIG. 2 shows an enlarged view of the collector 3, incorporating its various fittings 2 and those other capped fittings 4 as previously reviewed in the description of FIG. 1. Its support bracket 12 is also clearly shown. At the lower end of the collector 3 is the outlet port 5, that holds the levered valve 6, that has attached thereto the singular drain hose 9, that connects by its fitting 10 to the drain outlet port 11, as previously described.

Figure 3:
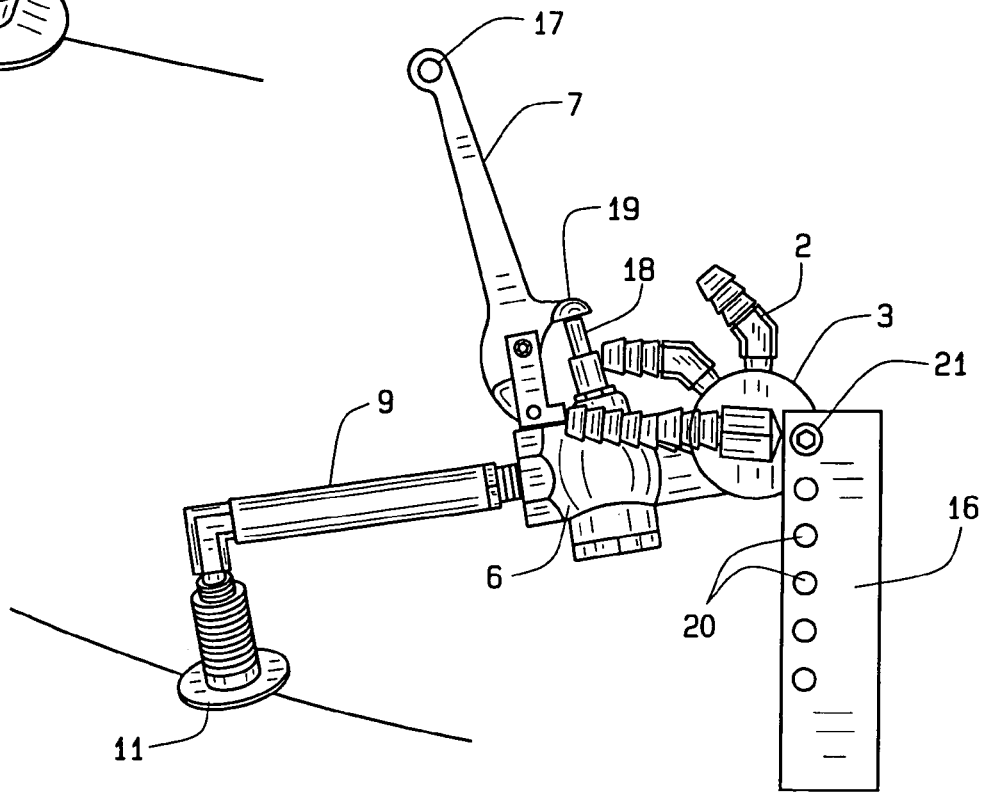
FIG. 3 is a side view of the drainage collector, etc., as shown in FIG. 2.

In addition, FIG. 3 shows how the lever 7 incorporates an aperture 17 for connection of a cable (not shown) thereto, that may lead up to the operator's panel, and which can be manually actuated, for opening of the valve, to achieve drainage. As can be seen, this type of a lever actuated valve normally includes a stem 18, that extends interiorly of the valve, and which when either forced downwardly, or released, as by means of the stop 19, allows for opening of the valve to let fluid pass therethrough, and to the singular flow line or tube 9 and out of the drain 11. In addition, this type of a lever actuated valve is normally spring biased (the spring not shown herein), so that once the operator's cable is released, the lever will be biased back into its position for closing off the valve, and preventing any further flow of water or other fluids therethrough.

As can also be seen in FIG. 3, the various arms 15 and 16 that support the drainage collector 3 have a series of vertically aligned apertures, as at 20, provided through each arm, so that upon installation of the collector thereto, by means of the threaded or otherwise fastener 21, the installer can be assured that the collector 3 is located upon a slight incline, as noted in FIG. 2, to assure that even any water remaining in the collector is drained out, when the boat engine is evacuated of its coolant fluids or water.

Figure 4:
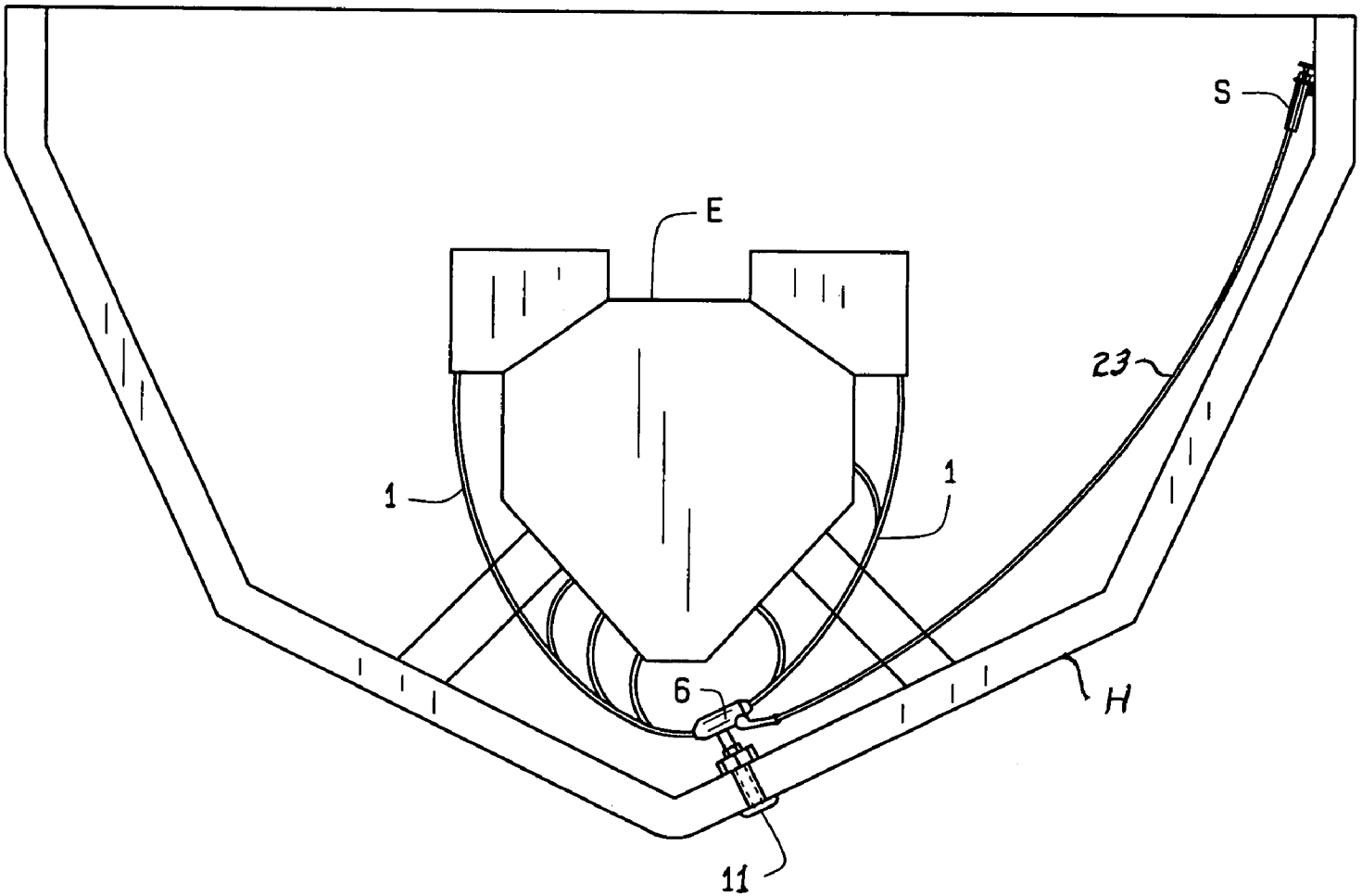
FIG. 4 is a cross sectional schematic of the boat hull, located engine, and the drainage system of this invention.

FIG. 4 shows the boat hull H in a schematic view, disclosing the engine E that is supported upon the hull. The various components of the engine that need to be drained, are all connected by means of the various drain hoses 1, as can be noted. They extend down and connect to the drainage device, as previously explained, and are operated by the lever valve 6, that allows for drainage of any collected water from the drainage collector 3, as previously reviewed. The drain valve then allows for the drainage of the water out of the hull drain 11, as can be seen. In addition, the cable 23 indicates from the operator switch S, down to the lever of the valve, to provide for either manual, or mechanical or electrical manipulation of the valve, when it is desired to open the same, and drain the entire engine of any of its cooling water.

In order to use and operate the drainage device of this invention, obviously, the boat must be lifted out of the water on a boat lift. The boat lifts are now very common at private boat docks, for lifting boats out of the water at their individual boat slips, and for storing the boat out of the water as when not in usage.

Other systems drain the water into the bilge area, through multiple drain valves, that must be accessed through the engine compartment. Most of the water is then pumped overboard, but not all of it. This is understandable. An example of this type of system is one identified as the Minute Drain from a company located in Rogers, Ark. This type of a system drains into the bilge area, and while effective for its own purposes, may not be especially desirable for the sport cruiser type of boat, with a lower interior within its hull. There may be areas such as the berths, a galley, and seating areas, etc. Remaining water in the bilge over time can create mold and mildew, as previously referred to, in these living areas, causing damage to the surface of these types of furnishings, and their fabrics, and in general, as well known, can create unhealthy conditions.

To accomplish the benefits of this current invention, and to provide a drainage through the hull, all that is required is a small hole that is approximately one inch in diameter, that must be drilled through the bottom of the hull. A low profile, through the hull type of drain port must be installed and thoroughly sealed by means of sealing means such as O-rings or gaskets, through the bottom of the boat, and held securely in place with a drain means locknut that is installed from within the inside of the hull. The spring loaded drain valve is mounted to the end of the through hull drain port inside of the hull. The drain hose assembly is connected to the valve. All this is done without the need or usage of any type of a bilge system.

Once the through the hull type of marine engine quick drain system is properly installed, all the operator need do, once the boat has been lifted upwardly by its lift, and moved out of the water, is to simply pull a remotely located pull handle, that may be at a location where the operator of the boat functions, pull the handle either manually, or to initiate a switch for opening of its valve lever, to actuate the spring loaded drain valve lever. Once this is done, and the valve is opened, the water will then drain by gravity from the areas of concern within the engine block, through the drain port provided in the bottom of the hull, and back into the lake without depositing any water into the boat's bilge area. After the water has finished draining, which can be determined simply by listening to the sound of the water draining, and its cessation, the operator simply releases the pull handle or the operating switch to allow the valve to reclose, generally by spring biased action, which closes off the water drained engine. When the boat is then ready for reusage, some time later, even if the weather has been very inclement, lower than the freezing zone, the boat is simply operated, its engine pumping system draws water from the lake, back into the engine, for coolant purposes, thereby necessitating no further action on the part of the boat owner, once previous drainage has occurred.

The engine has now been easily and conveniently drained of water, in a short period of time, without any entering the engine compartment, and without the dumping of any water into a bilge area, as required in other structured boats.

Variations or modifications to the subject matter of this invention may occur to those skilled in the art upon review of the structure of the invention as provided herein. Such variations, within the spirit of this development, are intended to be encompassed within the scope of any invention described herein. The specific description of the invention, and its preferred embodiment, as provided, and its depiction in the drawings, are set forth for illustrative purposes only.

I claim:

1. A marine engine quick drain system comprising a drainage collector, said drainage collector capable of draining any fluids flowing therethrough, flow tubes connecting between the drainage collector and a boat engine so as to drain all fluids from the engine as when a boat is not in use, an actuable valve connecting to the collector and which when actuated allows for drainage of liquids from the collector, said valve connecting by flow means to a hull drain port installed through the bottom of the boat hull to allow for drainage of all fluids from the engine and the drainage system back into the lake when the boat is lifted and stowed, said drainage collector comprises a cylindrical member, said cylindrical member having a series of valves radiating from the collector and opening into its volumetric interior, whereby the drainage collector functions as a collection means to which all of the fluids flowing within the marine engine can gravitate towards for drainage.

2. The marine engine quick drain system of claim 1 and including said valve connecting at an end of the drainage collector, and said valve, when opened, providing for drainage of all of the fluids from the engine and back into the lake when the boat is stowed.

3. The marine engine quick drain system of claim 2 wherein said valve includes a handle, and the valve capable of manual manipulation into an open or closed position.

4. The marine engine quick drain system of claim 2 wherein said valve connects to one end of the drainage collector, and said valve being connectable to means providing for its automatic opening and closing when draining the engine, and while the boat is lifted and stowed.

5. The marine engine quick drain system of claim 2 and including said drain part being installed through the bottom of the boat, and a flexible flow tube interconnecting between the valve, and the drain part, to provide for drainage of all fluids from the engine and back into the lake.

6. The marine engine quick drain system of claim 2, and including a bracket, said bracket cooperating with each end of the drainage collector to support said drainage collector and valve above any boat hull.

7. The marine engine quick drain system of claim 6 wherein said bracket supports said drainage collector upon an incline, with the lower end of the drainage collector having the actuable valve connected thereto.

8. The marine engine quick drain system of claim 2 and including said flow tubes connected between the drainage collector and any boat engine being flexible, to provide for their arrangement between the drainage collector and various aspects of any boat hull to provide for full drainage of any liquids from the marine engine into the drainage collector for discharge.

9. The marine engine quick drain system of claim 2 wherein the drainage collector is arranged below any engine to which its flow tubes connect, and the drainage collector and its actuable valve being arranged above the hull drain port connecting through the bottom of the boat hull.

* * * * *